US007422066B2

(12) United States Patent
Rodrigues et al.

(10) Patent No.: US 7,422,066 B2
(45) Date of Patent: Sep. 9, 2008

(54) SYSTEM FOR DIRECT VERTICAL CONNECTION BETWEEN CONTIGUOUS SUBSEA EQUIPMENT AND METHOD OF INSTALLATION OF SAID CONNECTION

(75) Inventors: Roberto Rodrigues, Rio de Janeiro (BR); João Siqueira De Matos, Rio de Janeiro (BR); Robson Soares Junior, Rio de Janeiro (BR)

(73) Assignee: Petroleo Brasileiro S.A. - Petrobras, Rio De Janeiro (BR)

( * ) Notice: Subject to any disclaimer, the term of this patent is extended or adjusted under 35 U.S.C. 154(b) by 74 days.

(21) Appl. No.: 11/166,379

(22) Filed: Jun. 27, 2005

(65) Prior Publication Data

US 2006/0231266 A1 Oct. 19, 2006

(30) Foreign Application Priority Data

Mar. 10, 2005 (BR) ..... 0500996

(51) Int. Cl.
*E21B 29/12* (2006.01)

(52) U.S. Cl. ..... 166/341; 166/349; 166/381; 166/366; 166/85.1; 166/241.6; 166/368

(58) Field of Classification Search ..... 166/341, 166/338, 339, 344, 349, 368, 381, 77.51, 166/85.1, 241.6, 366
See application file for complete search history.

(56) References Cited

U.S. PATENT DOCUMENTS 3,308,881 A * 3/1967 Chan et al. ..... 166/340
3,353,595 A * 11/1967 Gruller et al. ..... 166/341
3,448,799 A * 6/1969 Ahlstone ..... 166/346
3,775,986 A * 12/1973 Daughtry ..... 405/169
4,023,619 A * 5/1977 Marquaire et al. ..... 166/341
4,109,478 A * 8/1978 Gracia ..... 405/195.1
4,192,383 A * 3/1980 Kirkland et al. ..... 166/341
4,194,857 A * 3/1980 Chateau et al. ..... 405/203
4,211,281 A * 7/1980 Lawson ..... 166/345
4,437,521 A * 3/1984 Richardson et al. ..... 166/341
4,438,817 A * 3/1984 Pokladnik et al. ..... 166/341

(Continued)

FOREIGN PATENT DOCUMENTS

BR PI 0301255-7 12/2004

(Continued)

*Primary Examiner*—Thomas A Beach
(74) *Attorney, Agent, or Firm*—Sughrue Mion, PLLC

(57) ABSTRACT

A system for the direct vertical connection between contiguous sub sea equipment is described, having one or more hydrocarbon flow and/or control interconnection between same, so as to dispense with the use of connecting jumpers. One mode of said system comprises a PuAB 221 vertically and directly connected to a PrAB 104. Equipment is directly fixed through the PuAB connector 251 with a PrAB 104-production mandrel 107, said mandrel being fitted with a funnel guide 112. PuAB 221 is fitted with a funnel 224 so as to guide the drilling of a cased borehole 220 in the marine soil 101, close to well 111. Once the cased borehole 220 is ready, PuAB 221 will be locked to the casing of said borehole 220 by means of a locking system, so as to complete the mechanical and hydraulic connection between the two devices, PuAB and PrAB or HWCT. Two modes of the method for installation of said system are also described.

16 Claims, 14 Drawing Sheets

U.S. PATENT DOCUMENTS

| | | | | | |
|---|---|---|---|---|---|
| 4,544,036 | A | * | 10/1985 | Saliger | 166/341 |
| 4,625,806 | A | * | 12/1986 | Silcox | 166/358 |
| 4,661,016 | A | * | 4/1987 | Baugh et al. | 405/169 |
| 4,662,785 | A | * | 5/1987 | Gibb et al. | 405/195.1 |
| 4,673,313 | A | * | 6/1987 | Baugh et al. | 405/224.3 |
| 4,732,215 | A | * | 3/1988 | Hopper | 166/366 |
| 4,848,474 | A | * | 7/1989 | Parizot et al. | 166/366 |
| 4,900,433 | A | | 2/1990 | Dean et al. | |
| 5,005,650 | A | * | 4/1991 | Hopper | 166/339 |
| 5,040,607 | A | * | 8/1991 | Cordeiro et al. | 166/366 |
| 5,195,589 | A | * | 3/1993 | Mota et al. | 166/341 |
| 5,244,312 | A | * | 9/1993 | Wybro et al. | 405/204 |
| 5,310,006 | A | * | 5/1994 | Freitas et al. | 166/339 |
| 5,320,175 | A | * | 6/1994 | Ritter et al. | 166/339 |
| 5,458,440 | A | * | 10/1995 | Van Helvoirt | 405/169 |
| 5,526,882 | A | * | 6/1996 | Parks et al. | 166/339 |
| 6,003,604 | A | * | 12/1999 | Wilkins | 166/366 |
| 6,036,749 | A | | 3/2000 | Ribeiro et al. | |
| 6,059,039 | A | * | 5/2000 | Bednar et al. | 166/344 |
| 6,182,763 | B1 | * | 2/2001 | Ingebrigtsen et al. | 166/366 |
| 6,352,114 | B1 | * | 3/2002 | Toalson et al. | 166/343 |
| 6,419,458 | B1 | | 7/2002 | Lower et al. | |
| 6,688,392 | B2 | | 2/2004 | Shaw | |
| 6,719,059 | B2 | * | 4/2004 | Dezen et al. | 166/368 |
| 7,296,629 | B2 | * | 11/2007 | Bartlett | 166/348 |
| 7,314,084 | B2 | * | 1/2008 | Rodrigues et al. | 166/344 |
| 2003/0111229 | A1 | * | 6/2003 | Clark | 166/368 |
| 2003/0155119 | A1 | * | 8/2003 | Crain | 166/245 |
| 2004/0140098 | A1 | * | 7/2004 | Aguilera | 166/341 |
| 2005/0016735 | A1 | * | 1/2005 | Ireland et al. | 166/352 |
| 2005/0217857 | A1 | * | 10/2005 | Rodrigues et al. | 166/351 |
| 2006/0157241 | A1 | | 7/2006 | Rodrigues et al. | |

FOREIGN PATENT DOCUMENTS

| | | | |
|---|---|---|---|
| BR | PI 0400926-6 | | 11/2005 |
| BR | PI 0404603-0 | | 6/2006 |
| GB | 2028400 | * | 3/1980 |

* cited by examiner

SYSTEM FOR DIRECT VERTICAL CONNECTION BETWEEN CONTIGUOUS SUBSEA EQUIPMENT AND METHOD OF INSTALLATION OF SAID CONNECTION

FIELD OF THE INVENTION

The present invention relates to the field of subsea equipment, designed for the production of hydrocarbons in general, where in spite of these equipment being installed one at a time, one or more interconnections of hydrocarbon flow and/or of control between same are considered, said connections being usually performed by jumpers, that are lines and umbilicals the ends of which are fitted with connectors.

The inventive concept dispenses with the need of connecting jumpers by using devices that enable a direct vertical connection in the subsea between at least two contiguous pieces of subsea equipment. More specifically, the present invention can be applied for integrating a Production Adapter Base (PrAB) or a Horizontal Wet Christmas Tree (HWCT) or manifolds fitted with Pumping Modules (Pumping Adapter Bases, PuAB).

The invention relates still to the method for direct installation and vertical connection (without connecting jumpers) of at least two contiguous subsea pieces of equipment.

BACKGROUND INFORMATION

Whenever hydrocarbons are to be produced offshore, production and injection subsea wells should be drilled, as well as subsea equipment should be installed, such as Wet Christmas Tree (WCT), manifolds, PLET (pipe line end termination), PLEM (pipe line end manifold), Pumping Adapter Bases (PuAB), Production Adapter Bases (PrAB), flow lines and risers between the wellhead and the production unit. Such production unit can be placed on a ship, on a platform or even on shore.

In spite of the fact that many of such equipment are installed separately in the subsea in independent operations, they should operate in an interconnected way, allowing the flow of fluids such as hydrocarbons, gas or water and sometimes control commands and electrical measurement signals between same. Nowadays, such interconnections between subsea equipment are implemented following the installation of the subsea equipment, with the aid of flow lines and control umbilicals or jumpers, the ends of which are fitted with mechanical or hydraulic connectors for effecting the fixing or locking and sealing between such lines and parts (mandrels) of the equipment which have been previously installed in the subsea.

Usually the interconnection of previously installed equipment in the subsea using flow lines can be performed with the aid of two kinds of flow lines: flexible lines and rigid or stiff lines.

Flexible lines are endowed with certain mechanical features (flexibility), and do not require measurements (metrology) between the points to be interconnected, since their flexibility makes possible to adapt their geometry to the existing conditions of angles and distance or space between the points to be interconnected.

Rigid lines (made up of short spans of rigid pipes and accessories such as bends) bear certain mechanical features (rigidity) that require subsea assessment of angles and distances between the points to be interconnected, for further onshore manufacture of the flow line span to be installed in the sea bottom.

However, interconnecting lines the ends of which are fitted with connectors or jumpers, besides their high cost, require the use of sophisticated ships, this leading to high installation costs.

Among the subsea equipment to be installed and that should bear such flow interconnections are the Pumping Adapter Bases or PuAB designed to support and accommodate pumping units. Such pumping units can use several types of pumps, among which, the Electrical Submersible Pumps (ESP's), as well as multiphase pumps. The geometry of ESP pumps makes them tall and thin, designed to be installed within wells while multiphase pumps have a compact geometry, designed to be installed in the marine soil (out of the well).

From Brazilian Application PI 0301255-7 of the Applicant and herein completely incorporated as reference, it is known that it is possible to utilize a pumping module directly connected to a subsea equipment such as a wellhead and WCT unit. Such pumping module is made up of a closed tubular body and a hydraulic connector, where such connector is coupled to the flow mandrel of the subsea equipment previously installed in the sea bottom.

In spite of the fact that the subject matter of said Brazilian application enables a direct connection between subsea equipment, a drawback of the technology presented therein is the need to make modifications by altering the normal manufacture standard through increased weight, dimensions and cost of the WCT unit. Besides, the proposed layout does not facilitate the installation of long ESP's units having tens of meters.

A further drawback of the described system is that it is hard to apply same to already existing wells, since some parts of the wellhead/WCT unit should be exchanged, that is, requires the well to be re-completed and the production string withdrawn.

U.S. Pat. No. 4,900,433 and U.S. Pat. No. 6,036,749 cite that a pump similar to an ESP is installed in the interior of a dummy well, such well being built aiming at accommodating the separation and pumping unit, as well as driving the flow of oil from the inlet of such well up to the pump suction installed in the interior of same.

Also, from U.S. Pat. Nos. 6,419,458 and 6,688,392 it is known that it is possible to install a subsea pile-sump pumping arrangement similar to an ESP, hydraulically connected to a dummy well.

Brazilian Application PI 0400926-6 (and corresponding U.S. application Ser. No. 10/982,848) of the Applicant and equally herein completely incorporated as reference teaches that it is possible to install a pumping module housed within a cased borehole (hollow pile) in the marine soil and coupled to a PuAB. Such borehole is located apart from the wellhead, requiring the installation of short flow lines (tens of meters) and lines (umbilicals) for control and data acquisition. Those connecting jumpers, although short, having a few tens of meters, require high costs in material and ships to be installed.

Brazilian Application PI 0404603-0 of the Applicant and herein also completely incorporated as reference teaches the installation of a pumping module inserted within a cased borehole (hollow pile), or in the water-capturing well itself in water-capturing and injection systems of subterranean aquifers.

Thus, in spite of the previous developments, there is still in the art the need of a system and method enabling the installation and direct connection with hydrocarbon flow and/or control interconnection (dispensing with flow lines fitted with connectors) of any subsea equipment, for example, a PUAB described in Brazilian PI 0400926-6 to at least another contiguous, previously installed subsea equipment, such system and method being described and claimed in the present application.

SUMMARY OF THE INVENTION

Broadly, the system for direct vertical connection with hydrocarbon flow and/or control interconnection between at least two subsea pieces of equipment utilized in the production of hydrocarbon fluids from the sea bottom, one of such equipment being already installed, comprises a flow mandrel with a funnel guide integral to the first subsea installed equipment and a base with a connector, so as to effect the insertion and locking of the base connector to the mandrel of the first equipment with the aid of the funnel guide. Such funnel guide serves as an approaching guide between the two pieces of equipment, whereby a mechanical and flow connection is established between the equipment and said base, dispensing with the use of connecting jumpers.

Alternatively the adaptation or welding of a structure, fixed or moving with the aid of a hinge (which can rotate) is effected in the PuAB or HWCT. Such structure is fitted with a funnel aiming at serving as a template in executing a cased borehole in the marine soil. Such borehole can accommodate different kinds of arrangements, among which, a pumping module. Such arrangement is to be connected to a mandrel pertaining to the PuAB or HWCT. In this way a mechanical and flow connection is effected between the two underwater pieces of equipment, so as to dispense with the use of connecting jumpers.

A further alternative, which can be applied when the two pieces of equipment to be interconnected are a PrAB or a HWCT to a PuAB, is the use of a drilling base with two funnels. The second funnel requires the building of a new drilling base or the adaptation of an existing drilling base. This is done by fixing a structure, fixed or movable with a hinge (which can rotate) to a not yet installed, existing drilling base.

Thus, the invention provides a system for the direct vertical connection with hydrocarbon flow and/or control interconnection between at least two subsea pieces of equipment utilized for producing hydrocarbon fluids, one of such equipment being already installed, said system dispensing with the use of flow lines having connectors or jumpers.

The invention further provides a system for direct vertical connection with hydrocarbon flow and/or control interconnection between at least two pieces of equipment utilized for producing hydrocarbon fluids in the sea bottom, one of such equipment being already installed, the system being applicable to production as well as to injection wells, including systems for water-capturing from a subterranean aquifer and injection into a hydrocarbon reservoir, similar to those described in the above-cited Brazilian Application PI 0404603-0.

The invention provides still a system for direct vertical connection with hydrocarbon flow and/or control interconnection between at least two pieces of equipment utilized for producing hydrocarbon fluids in the sea bottom, one of such equipment being already installed, such system being applicable not only to new wells but also to already existing wells. This makes simpler the exchange of the elevation method for an existing well without the need to change the production string and WCT for installing ESP's.

The invention provides also a system for direct vertical connection with hydrocarbon flow and/or control interconnection between at least two pieces of equipment utilized for producing hydrocarbon fluids in the sea bottom, one of such equipment being already installed where the ESP, due to the fact that it is out of the petroleum well, can be installed or recovered by a rig fitted with a drill pipe riser as well as by a service ship using cables, this resulting in a great savings in cost.

The invention provides additionally a method for installation of said system for direct vertical connection between at least two pieces of equipment used in the production of hydrocarbon fluids in the sea bottom.

DETAILED DESCRIPTION OF THE PREFERRED MODES

Figure 1:
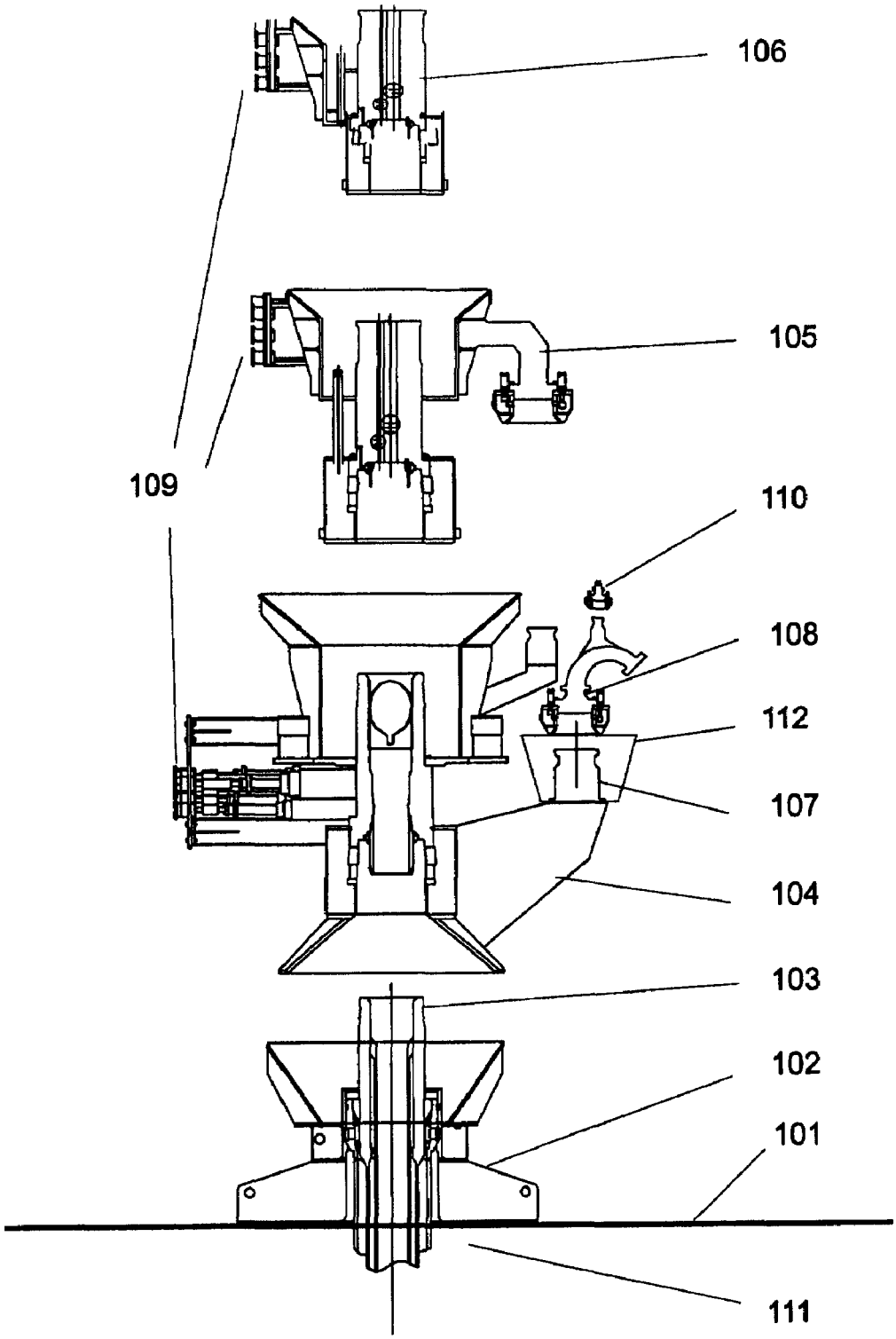
FIG. 1 RELATED ART
FIG. 1 attached shows schematically, for reference and identification only, the main equipment installed in a subsea well, made up of a wellhead, PrAB and Vertical WCT, the arrangement belonging to the state-of-the-art technique.

Throughout the present specification the meaning of the following terms is as follows:

Choke—Control valve for fluid flow rate

Jumper—Span of a flow line having connectors at its ends, the jumper interconnecting two subsea pieces of equipment.

Manifold—Flow lines collector

PUMO—Pumping Module

Pig—cleaning device for a flow line

Other usual terms have been previously defined in the specification.

The invention relates therefore to a system for direct vertical connection with hydrocarbon flow interconnection between two pieces of equipment utilized in the production of hydrocarbon fluids in the sea bottom where one of these equipment is previously installed, said system dispensing with the use of flow lines fitted with connectors, or jumpers.

More particularly, the present invention relates to the direct vertical connection of at least two pieces of subsea equipment with one or more interconnections of hydrocarbon flow and/or of control between same, such as, but not limited to, Production Adapter Base (PrAB) or Horizontal Wet Christmas Tree (HWCT), and Pumping Adapter Base (PuAB). The same concept and method can also be applied to the vertical connection (interlinking) of any two, contiguous pieces of equipment such as Wet Christmas Trees WCT (horizontal or vertical), Production Adapter Bases PrAB, flow collectors (manifolds), Pumping Adapter Bases PuAB, separation systems base, measurement system and choke bases, PLET (pipe line end termination), PLEM (pipe line end manifold), etc.

The invention equally encompasses the connection of two or more couples of pieces of equipment already connected.

Therefore one aspect of the invention is that system.

Another aspect is the method for installation of said system for the direct vertical connection with hydrocarbon flow and/or control interconnection between at least two pieces of such equipment.

Under the first aspect, the present system comprises several modes.

According to a first mode of the present system, a subsea equipment comprising a PuAB (Pumping Adapter Base) fitted with a connector can be directly interlinked and with hydrocarbon flow and/or control interlinking with a PrAB (Production Adapter Base) or with a HWCT (Horizontal Wet Christmas Tree) fitted with a production mandrel. The PUAB includes a funnel serving to guide the drilling or mechanical jetting of a cased borehole in the marine soil. Once the cased borehole is ready the PuAB will be locked (fixed) to the casing by a locking system, so as to complete the mechanical and hydraulic (flow) connection between the two pieces of equipment.

Upon said base can still be coupled other equipment, such as several kinds of modules (measurement, separation, pumping, heating), and Vertical Connection Modules (VCM) for interlinking with other wells.

According to a second mode of the present system, a combination of Brazilian Applications PI 0301255-7 and PI 0400926-6 cited above comprise providing a flow mandrel which is basically a mandrel including two orifices, one of the orifices being an inlet and the other one, an outlet, and a system of template funnel, both built in the equipment which is desired to integrate with a pumping module, for example a PUAB, or HWCT, or manifold, or PLET.

From the funnel through it is possible to drill a cased borehole in the marine soil, the distance of said borehole being perfectly known, a pumping module to be directly connected to the flow mandrel being housed in said borehole.

A third mode of the system of the invention is the adaptation (welding) of a structure, fixed or movable with a hinge (that can rotate), in the PrAB or HWCT. Such structure is fitted with a funnel designed as a template for executing a cased borehole in the marine soil. The use of said technique makes that the distance between the well and the cased borehole is perfectly known. Also, it is perfectly feasible to determine the distance between the top of the WCT unit outlet mandrel and the top of the casing installed at the end of the borehole. In this way it is possible to fabricate a PuAB that is connected vertically and directly to the outlet mandrel of the PrAB or HWCT and locked at the top of the previously installed casing. Afterwards, a pumping module to be housed in the cased borehole connected to the PuAB is installed.

A fourth mode of the present system, applicable when the two pieces of equipment to be interconnected are a PrAB or a HWCT to a PuAB, is the use of a drilling base having two funnels. The second funnel requires the building of a new drilling base or else the adaptation of an existing drilling base, by fixing a structure, fixed or movable with a hinge (that can rotate) to a not yet installed, existing drilling base. The function of the second funnel is as a template for executing a cased borehole in the marine soil.

In this way it is possible to drill the (production or injection) well while a cased borehole designed to house the pumping module is constructed, said borehole having a precise and previously determined known distance, making possible the direct vertical connection or fitting between the two pieces of equipment, so as to dispense with the need of connecting jumpers. The described modification in the drilling base destandardizes the state-of-the-art base units (drilling and PrAB) and requires an integrated building of same, that is, the same manufacturer should build them.

In spite of the fact that the above modes refer to the technique for direct vertical interconnection (without flow lines fitted with connectors) of two pieces of subsea equipment, in the particular case of one of them being a PrAB or a HWCT and the other one a PuAB, an expert can easily understand that it is possible to use the inventive system for direct vertical connection of any other two kinds of subsea equipment, for example, the interconnection of a pumping module and a manifold, or the interconnection of a pumping module and a PLET (Pipe Line End Termination), or still the interconnection of any other two kinds of subsea equipment such as separators, modules, manifolds, WCT unit, etc.

More particularly, the present invention relates to, while not being limited to, providing direct vertical connections between a PuAB and other subsea equipment, such as but not limited to, PrAB, HWCT, manifolds, PLET, PLEM, etc.

The invention relates still to the method for installing the PuAB and interconnecting same to the neighboring subsea equipment. Such method of direct vertical connection is also applicable for interconnecting any two contiguous subsea pieces of equipment.

The inventive system dispenses with the need to install connecting jumpers between two pieces of contiguous subsea equipment, greatly reducing in this way the fabrication job of such equipment and the ship time spent on installing the flow lines and bottom connections between equipment and flow lines, and consequently the costs involved.

Since in the present invention the ESP is placed external to the well, said ESP can be installed or retrieved by a rig fitted with a drill pipe riser or by a ship (cable operation). In both cases there are significant savings since, in case of failure of the ESP unit, a long (tens of days) work-over involving high costs of work-over rig and prolonged production interruption in the production well will not be required.

The concept of the invention is applicable to production wells as well as to injection wells, including in water capturing systems from subterranean aquifers and injection into hydrocarbon reservoirs, similar to those described in Brazilian PI 0404603-0.

A further advantage of the present system is the possibility of applying it not only to new wells as well as to existing ones, so as to make simpler the exchange of the lift method of an existing well without the need to exchange the production string and WCT for installing an ESP.

The invention will next be described by reference to the appended Figures. In the Figures the same number references will be used to indicate the same or similar parts.

FIG. 1 shows schematically, for reference only, the main state-of-the-art equipment of a subsea wellhead, which comprises: marine soil 101, drilling base 102, subsea wellhead 103, PuAB 104, WCT 105, WCT cap 106, production mandrel 107, Vertical Connection Module VCM 108, interface ROV panel 109, VCM installation tool 110, production or injection well 111, funnel guide 112.

Figure 2:
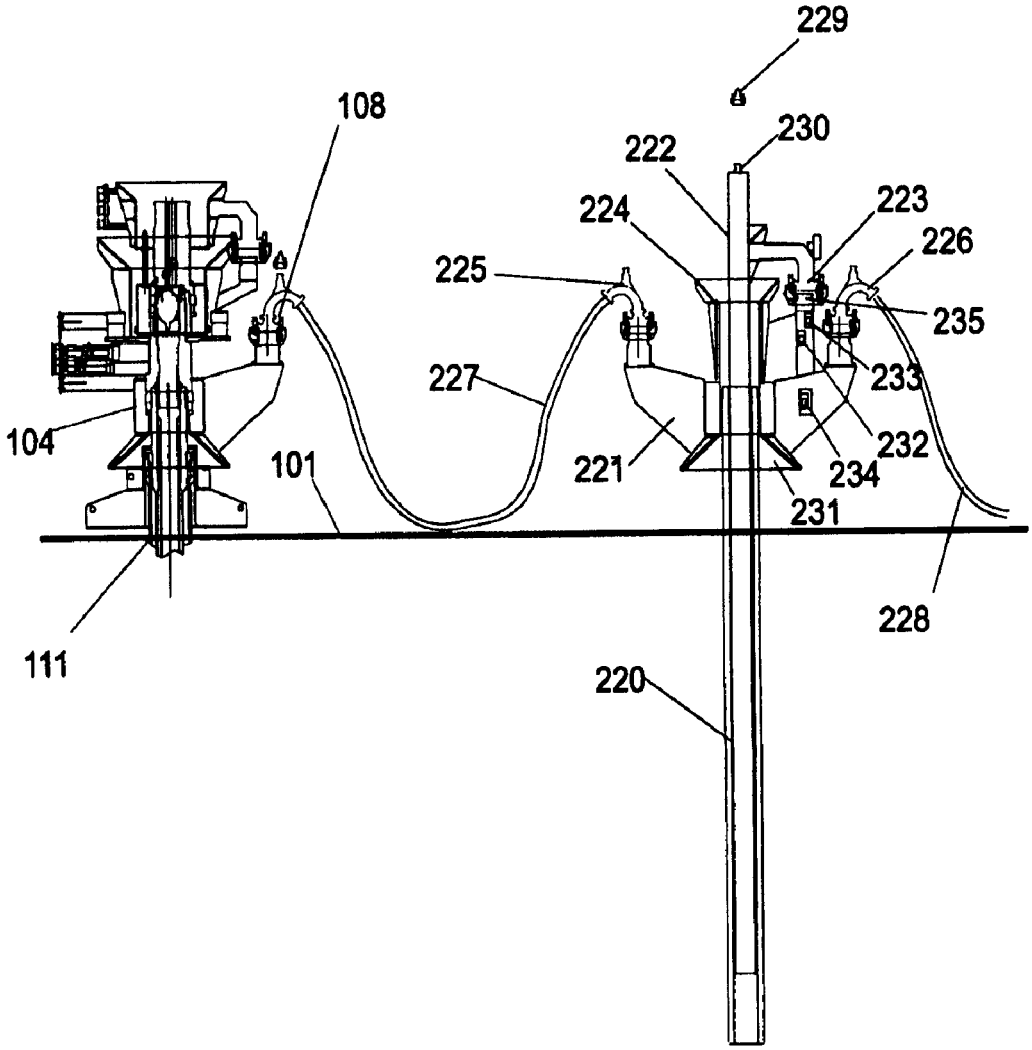
FIG. 2 RELATED ART
FIG. 2 attached shows schematically, for reference and identification only, the main equipment of a unit made up of a PuAB (Pumping Adapter Base) and a subsea-pumping module, which is the subject matter of Brazilian Application PI0400926-6.

FIG. 2 shows schematically, for reference only, the main equipment of a subsea pumping module unit 222 which is the object of Brazilian PI0400926-6, said module unit being interconnected to a well 111 by means of a jumper 227, the ends of which are fitted with a Vertical Connection Module VCM 108 and with a VCM 225. Further components are: cased wellbore 220, pumping Adapter base (PuAB) 221, pumping module 222, pumping module connector 223, pumping module funnel guide 224, suction VCM (Vertical Connection Module) 225, discharge VCM 226, jumper 227 upstream of the module, flow line 228 downstream of the module, pumping module installation tool 229, pumping module neck 230, and PuAB funnel guide 231.

Figure 3A:
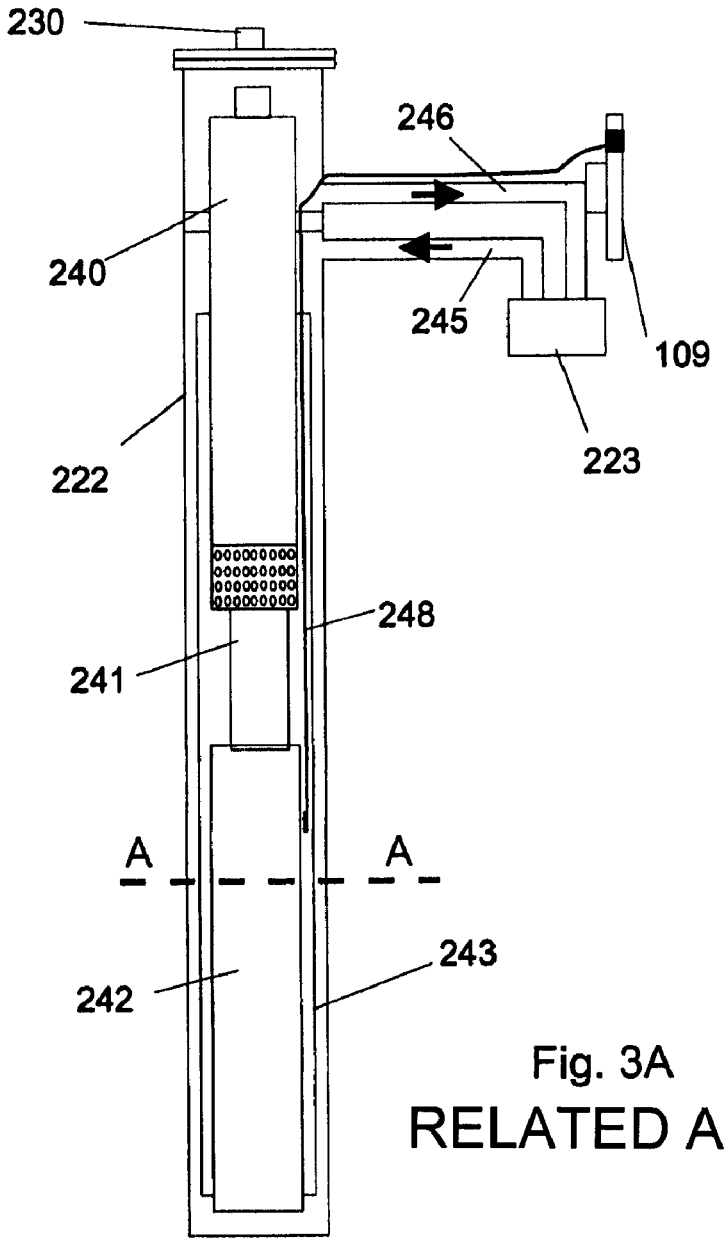
Fig. 3A RELATED ART
FIGS. 3A and 3B attached show schematically, for reference and identification only, the main equipment of a subsea-pumping module making the subject matter of Brazilian PI 0400926-6.
Figure 3B:
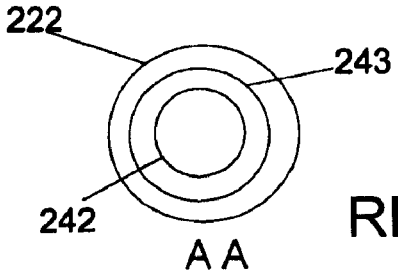
Fig. 3B RELATED ART

FIGS. 3A and 3B show schematically, for reference and identification only, the main components of a subsea pumping module 222 which is the subject matter of Brazilian PI0400926-6, where the main elements are: an ESP-type pump 240, protector 241, pump motor 242, shroud 243, flow inlet 245, flow outlet 246, connector 223, interface ROV panel 109, and installation neck 230.

Figure 4:
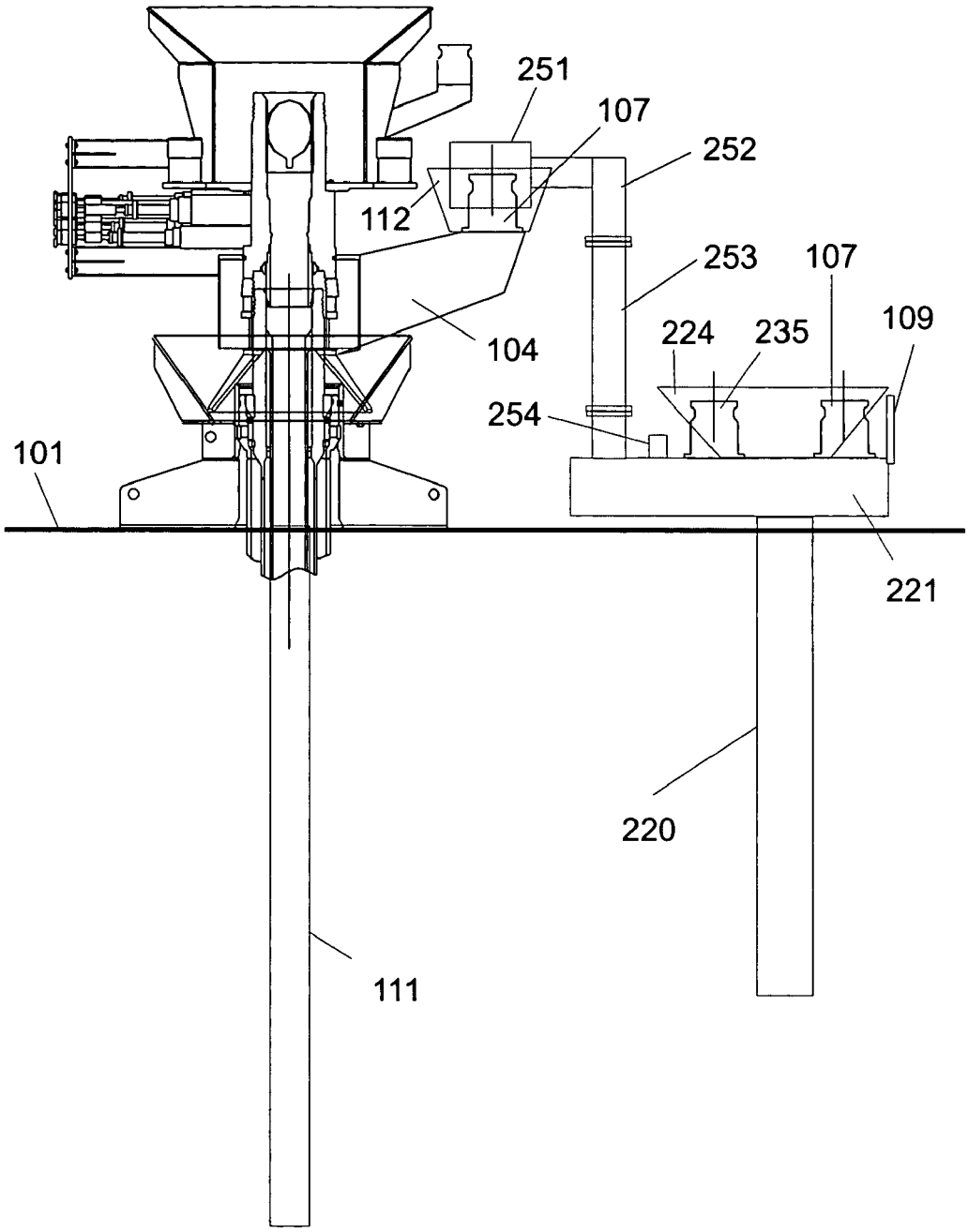
FIG. 4 attached shows schematically a PuAB vertically and directly connected (without any flow lines) to a PrAB.

FIG. 4 shows schematically a mode of the present application, including a PuAB 221 similar to that described in Brazilian PI0400926-6, vertically and directly connected to a PrAB 104. Locking is carried out directly through PuAB connector 251 with a production mandrel 107 of PrAB 104. Production mandrel 107 is fitted with a funnel guide 112. PuAB 221 is equipped with a funnel 224 to guide the execution (through drilling or jetting) of a cased borehole 220 in the marine soil 101 close (a few meters) to well 111.

Once the cased borehole 220 is finished, PUAB 221 will be locked (fixed) to the casing of said borehole 220 with the aid of a locking system, so as to complete the mechanical and hydraulic (flow) connection or interlinking between the two pieces of equipment, PUAB 221 and PrAB 104 or HWCT.

The cased borehole 220 will house a pumping module 222 (not shown in the Figure).

PuAB 221 can be installed by a rig using a drill pipe or by ship using a cable. For this purpose PuAB 221 is fitted with an installation neck 254 for fitting an installation tool—not shown in this Figure. The PuAB installation tool is similar to VCM installation tool 110 shown in FIG. 1. In case the marine soil 101 where the PuAB 221 is to be installed is irregular, the same can include a spool 253, the dimensions of which are altered so as to make possible to fit the height (elevation) relative to the marine soil 101.

Still referring to FIG. 4, an ROV (Remotely Operated Vehicle) interface panel 109 is shown. Said panel 109 is provided with interfaces for ROV actuating, having the following functions:

Locking and unlocking of connector 251;

Sealing test of connector 251.

Upon base 221 are coupled measurement modules, separation modules, pumping modules, heating modules and interconnecting module VCM 225 with other wells 111 (not represented).

Figure 5:
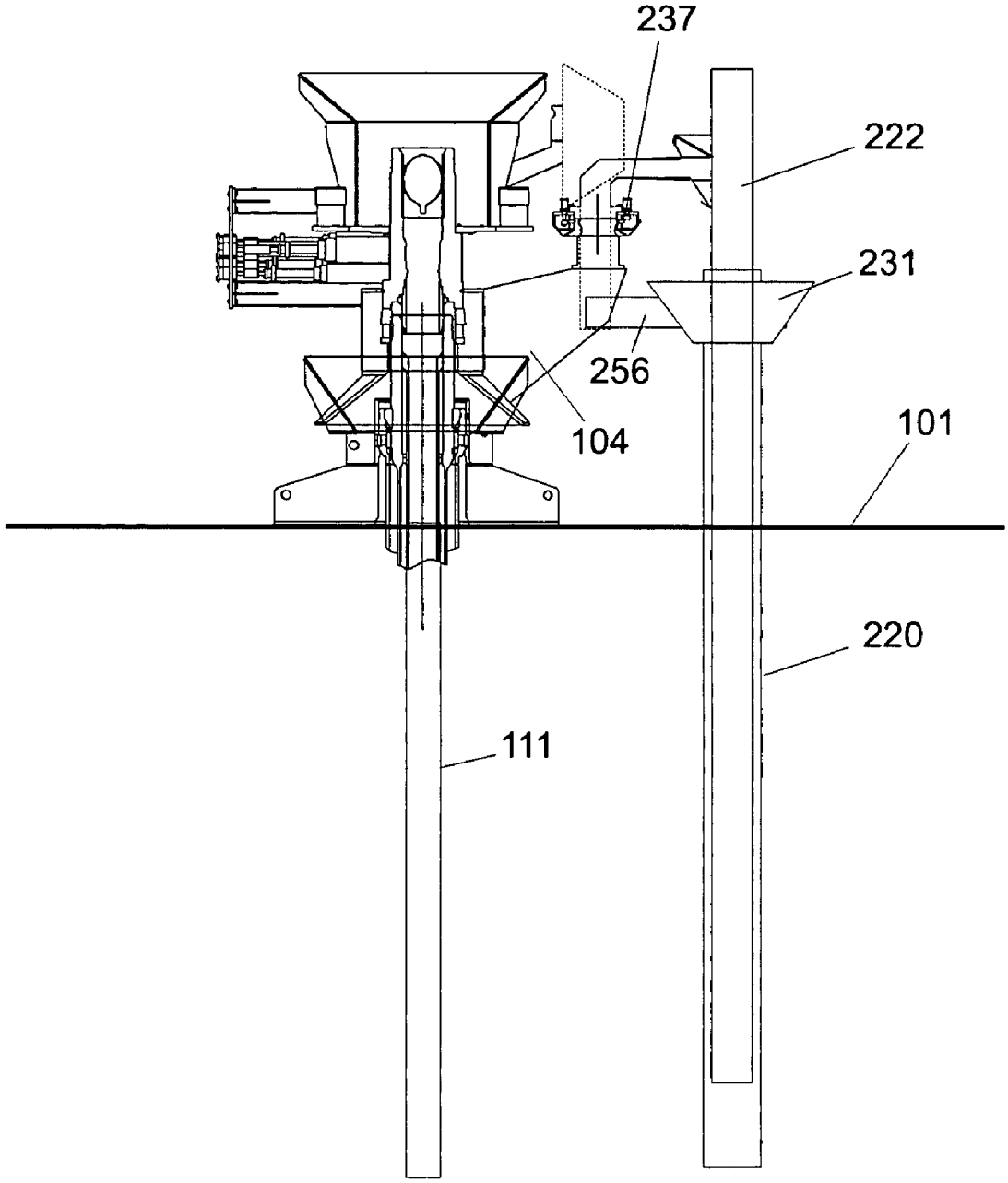
FIG. 5 attached shows schematically a PuAB modified by the installation of a flow mandrel having a structure with a hinge (90 degrees rotation), serving as a template for drilling a cased borehole in the sea bottom, contiguous to a (production or injection) well.

FIG. 5 shows schematically a further mode of the invention with a pumping module 222 housed in a cased borehole 220 and connected to a PrAB 104 with the aid of a flow mandrel 237, said mandrel being the subject matter of Brazilian PI0301255-7.

Still referring to FIG. 5, based on a conventional PrAB 104, the following components have been added to the HWCT or PrAB 104 shown: a flow mandrel 237 basically made up of three valves and one mandrel having two orifices (suction and discharge), and a structure 256 fitted with a hinge and funnel 231.

From funnel 231 on it is possible to construct (by drilling or jetting) a cased borehole 220 in the marine soil 101 at a perfectly known distance, where will be housed the pumping module 222 to be directly connected to flow mandrel 237, dispensing with the use of connecting jumpers.

Figure 6:
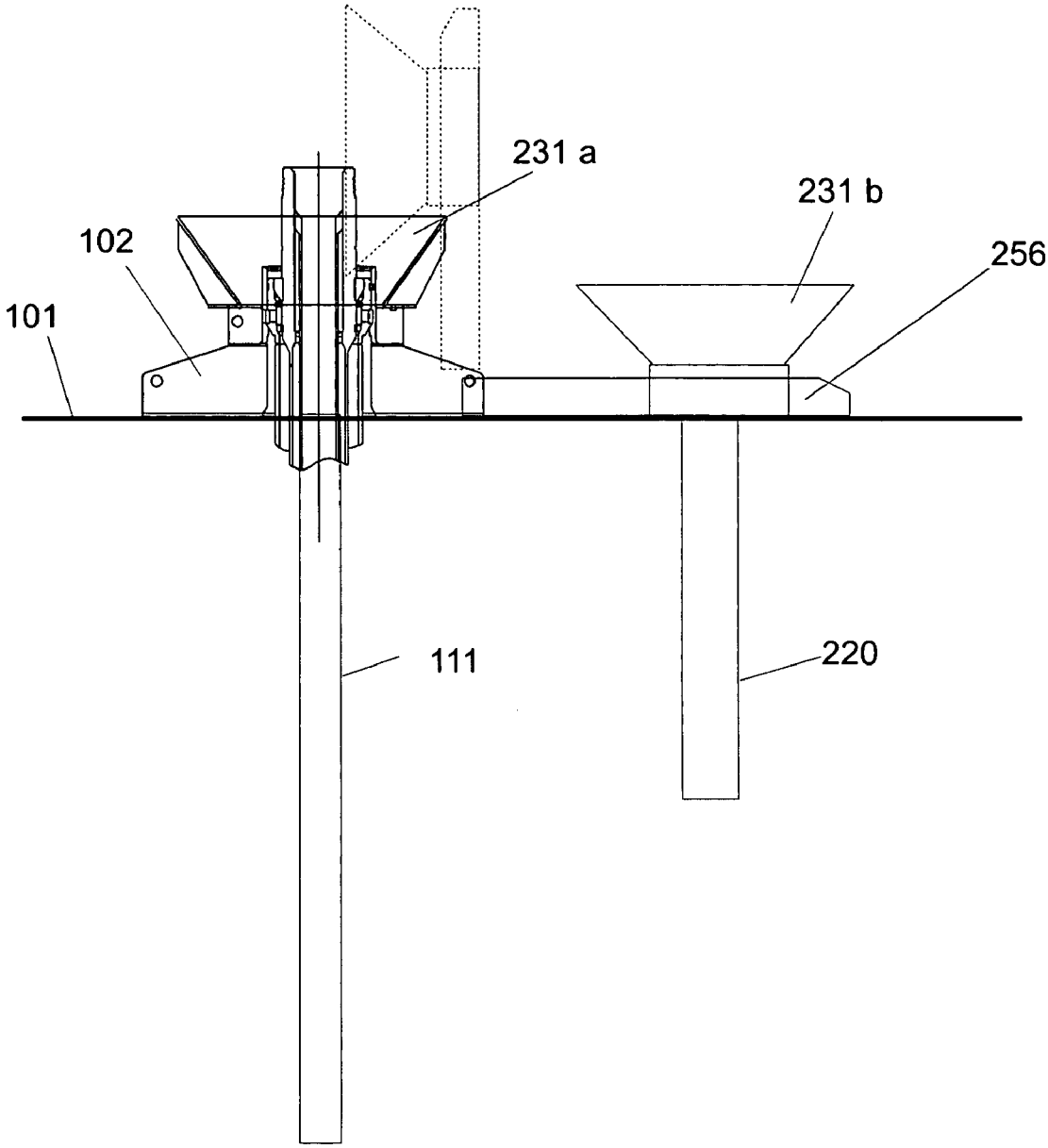
FIG. 6 attached shows schematically a wellhead/drilling base having a structure, fixed or having a hinge, allowing to executing a cased borehole contiguous to a (production or injection) well.

FIG. 6 shows schematically a drilling base 102 fitted with two funnels 231*a*/231*b* in the contour of same. The first funnel 231*a* will guide the drilling of well 111. Later on, guided by the second funnel 231*b* a cased hole 220 is constructed by drilling or jetting, close to well 111, in the marine soil 101. Said cased hole 220 will house a pumping module 222 (not represented). Structure 256 as represented herein is a structure with or without a hinge, similar to structure 256 of FIG. 5.

The perfect knowledge of the distance (dimension) between well 111 and the cased borehole 220 makes possible the direct connection (see FIG. 5) of the pumping module 222 with a PrAB 104 or HWCT with the aid of a flow mandrel 237 or production mandrel 107, dispensing with the use of connecting jumpers.

Figure 7:
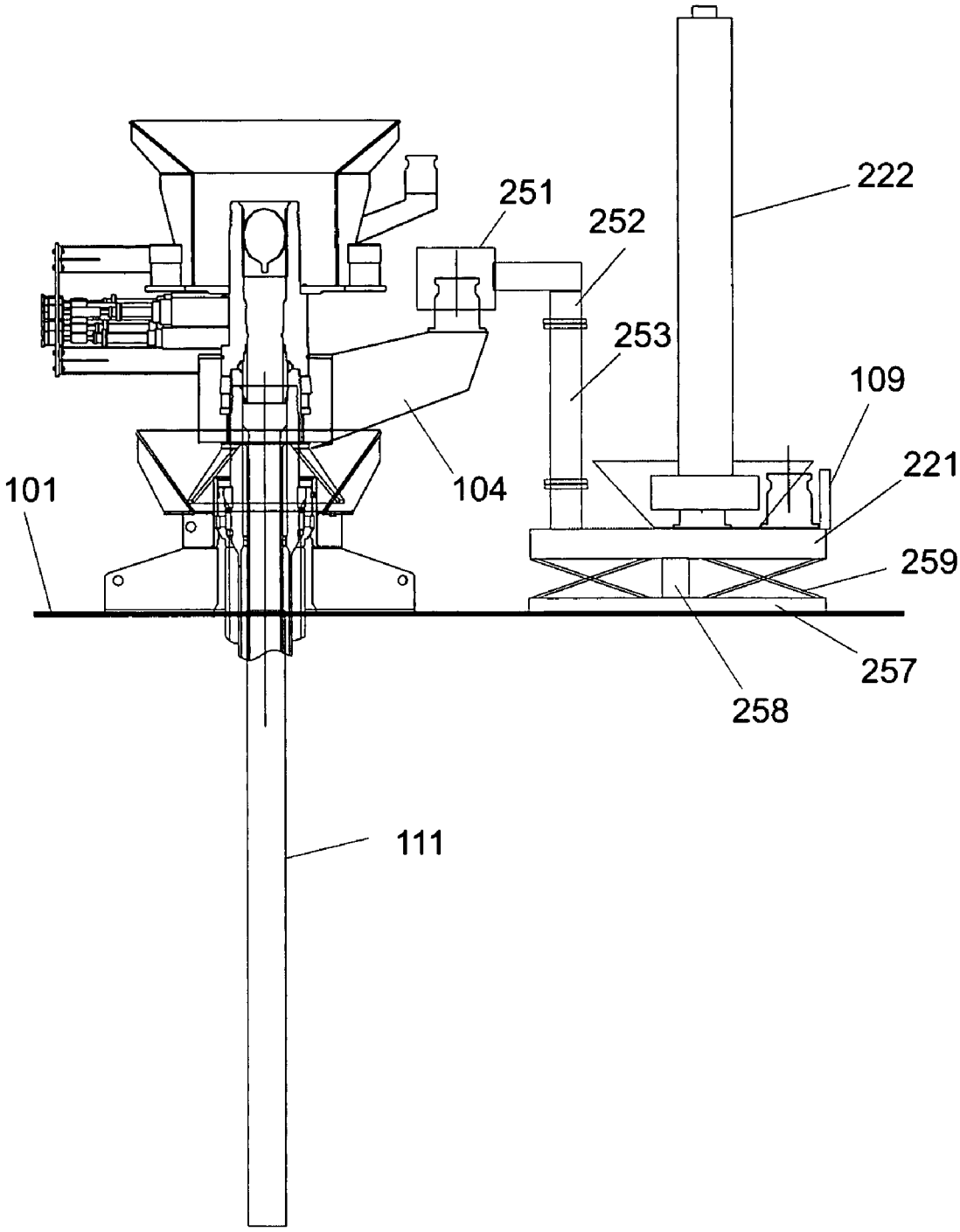
FIG. 7 attached shows the same concept of FIG. 4, however there is no cased borehole and the pumping module is connected to the PuAB directly supported by the marine soil.

FIG. 7 shows the same concept of FIG. 4, however there is no cased borehole 220 and pumping module 222 is connected to PuAB 221, which is directly supported by marine soil 101. Such concept enables the installation of a pumping module 222 including multiphase pumps or even conventional ESP's.

In case the marine soil 101 shows any unevenness (that is, it is not plane and horizontal), it is admitted to build an adjustable base made up of a sub base 257, a pantographic structure 259, and one or more hydraulic jacks 258 actuated with the aid of ROV panel 109.

It is also possible to provide PuAB 221 with a less precise height fit (elevation) through compensation in the rigid pipe 252 span, this being reached through modifications in the dimensions of spool 253 shown in the Figure.

Figure 8:
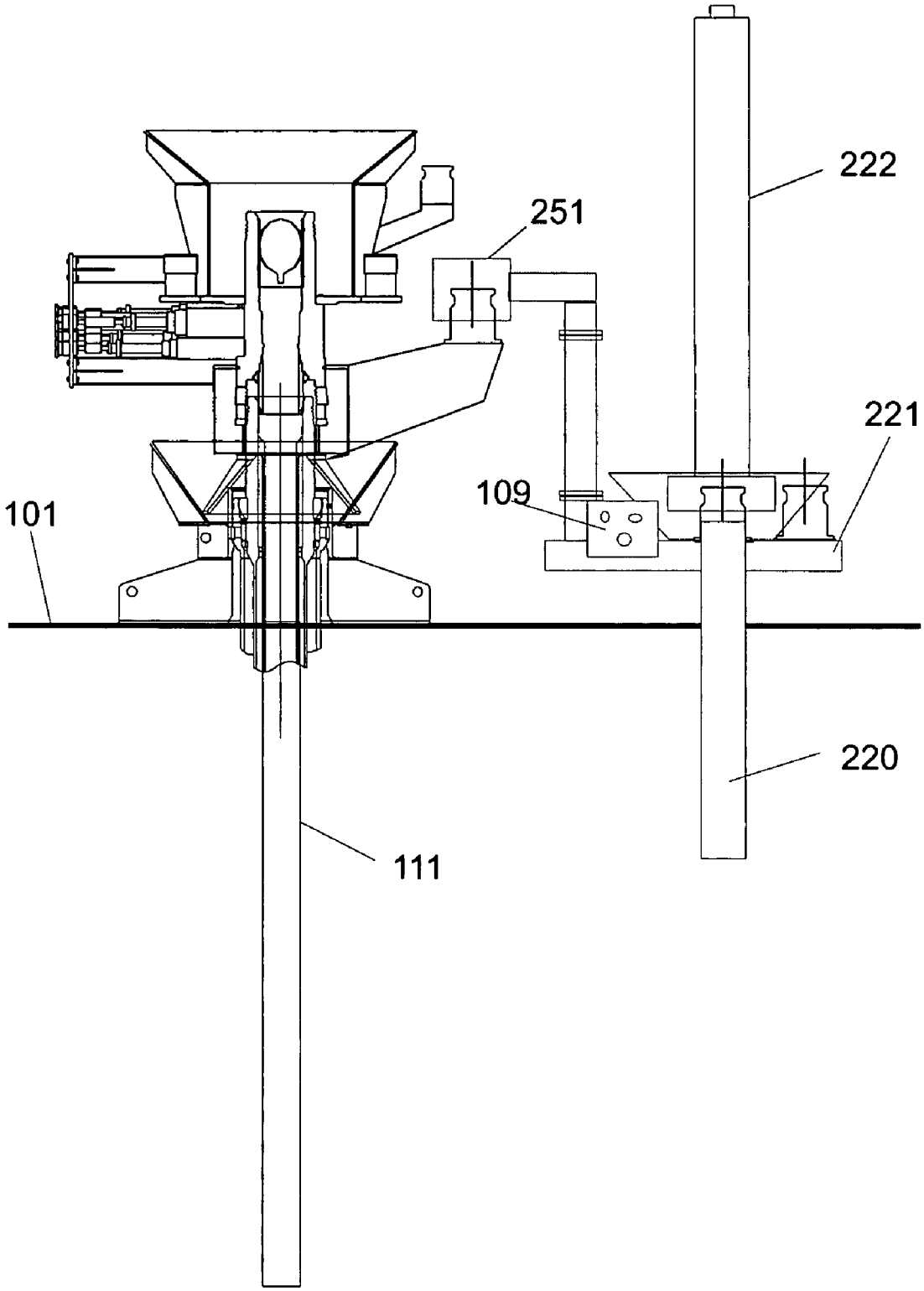
FIG. 8 attached shows the same concept as FIG. 4, however, the cased borehole works only as a structural base (pile, foundation), and the pumping module is external to said borehole.

FIG. 8 shows the same concept of FIG. 4, however cased borehole 220 is used only as a structural base (pile, foundation) and pumping module 222 is placed external to said cased borehole 220. Such concept makes possible to install pumping module 222 with pumps, either multiphase or even conventional ESP's.

Figure 9:
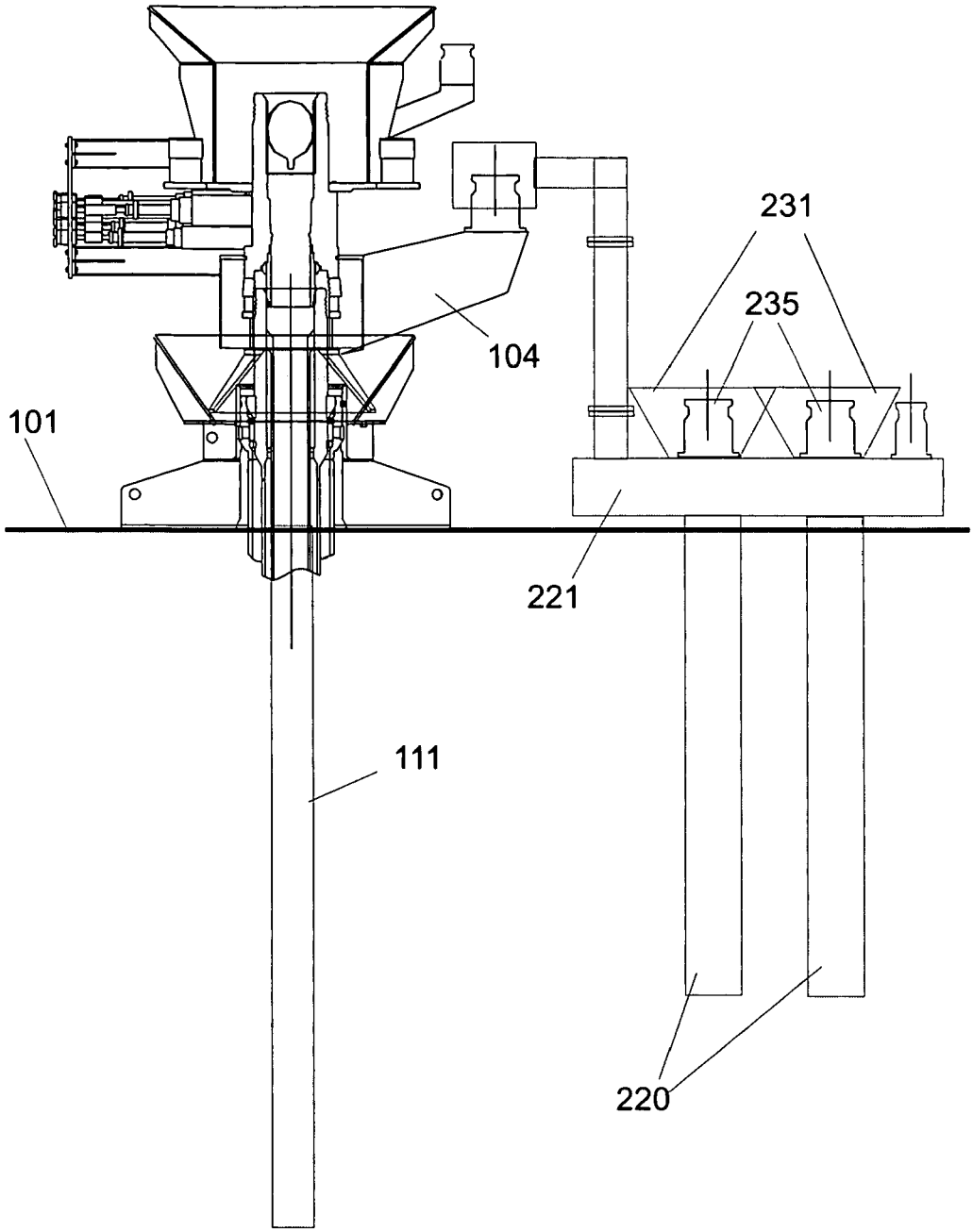
FIG. 9 attached shows an arrangement similar to that of FIGS. 4, 5, 6, 7 and 8, however there are two funnel guides so as to make possible to drill two cased boreholes and install two pumping modules.

FIG. 9 shows an arrangement similar to that of FIG. 4, however PuAB 221 is fitted with two funnel guides 231, so as to make possible to drill two cased boreholes 220 and the installation of two pumping modules 222 (not represented). In this case the PUAB 221 will have two mandrels 235 instead of only one mandrel.

According to a further, non-represented alternative, two pumping modules 222 are installed in one single cased borehole 220 having a larger diameter.

It should be borne in mind that, although not represented in the Figures, it is easily understandable by the experts that it is equally possible to apply the concept of two pumping modules 222 for the invention modes illustrated in FIGS. 5, 6, 7 and 8.

It is also known in the state-of-the-art technique, as taught in Brazilian PI0400926-6, to install two ESP units in a same module. The difference between the mode with two independent pumping modules and the mode of two ESP's in the same pumping module is that in the first case it is possible to retrieve only one pumping module for maintenance while production is kept running with only the remaining module.

Figure 10:
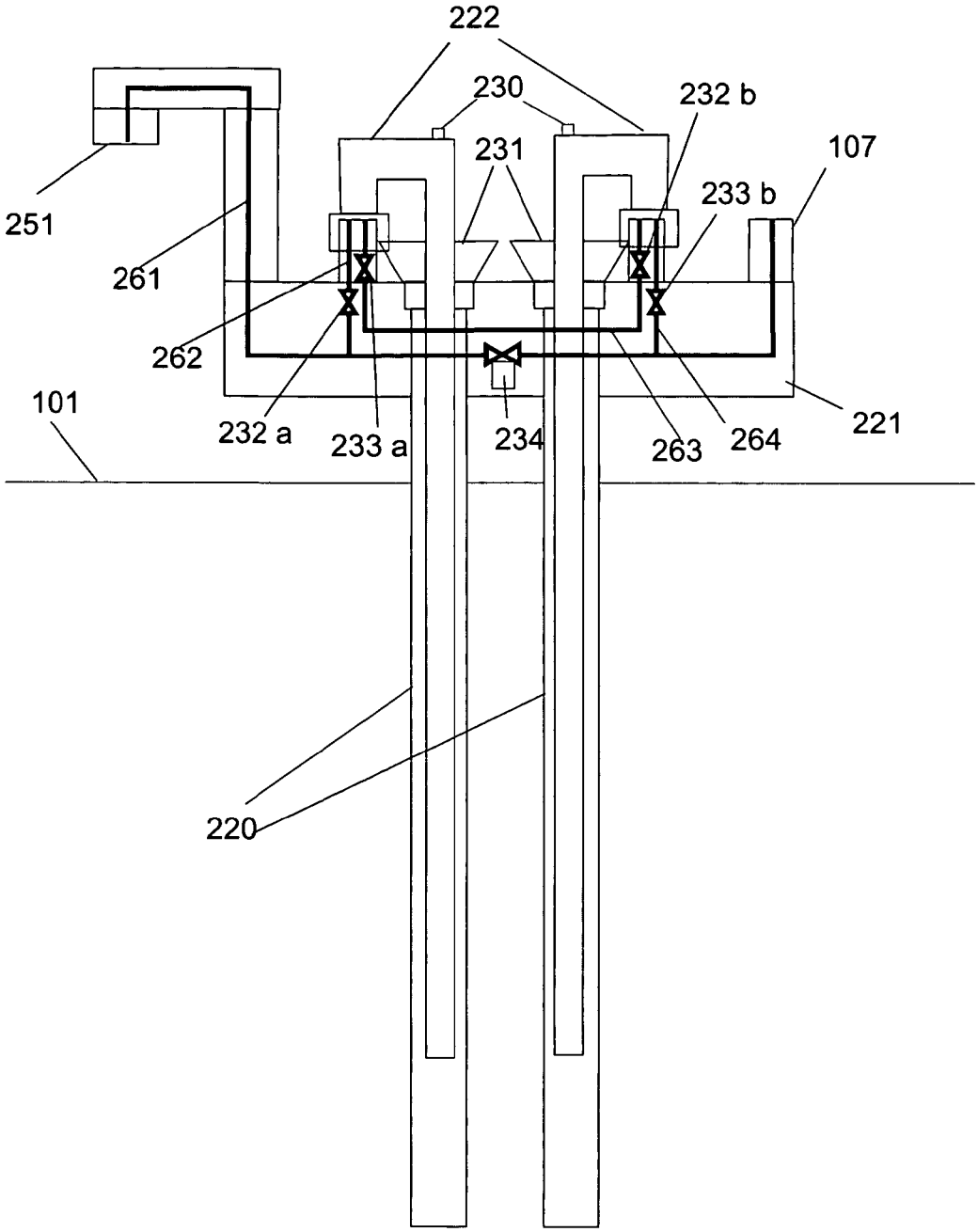
FIG. 10 attached shows a flow diagram of the PuAB having two pumping modules installed in a same PuAB.

FIG. 10 shows a flow diagram of a PuAB 221 having two pumping modules 222 housed in two cased boreholes 220, as illustrated in FIG. 9. A tubular flow line 261 interconnects the PuAB 221 connector 251 with the PrAB 104 exporting mandrel 107 (not represented), said line being fitted with a valve having a hydraulic actuator 234 for passage of a flow line cleaning device or pig.

Said same tubular flow line 261 is fitted with two derivations, a first derivation 262 interconnected to the suction of the first pumping module 222 and a second derivation 264 that is interconnected with the discharge of the second pumping module 222. A second tubular flow line 263 interlinks the discharge of the first pumping module 222 with the suction of the second pumping module 222.

Further, there are four ROV-operated blocking valves: a valve 232*a* at the suction of the first pumping module 222, a valve 233*a* at the discharge of the first pumping module 222, a valve 232*b* at the suction of the second pumping module 222, and a valve 233*b* at the discharge of the second pumping module 222.

Figure 11:
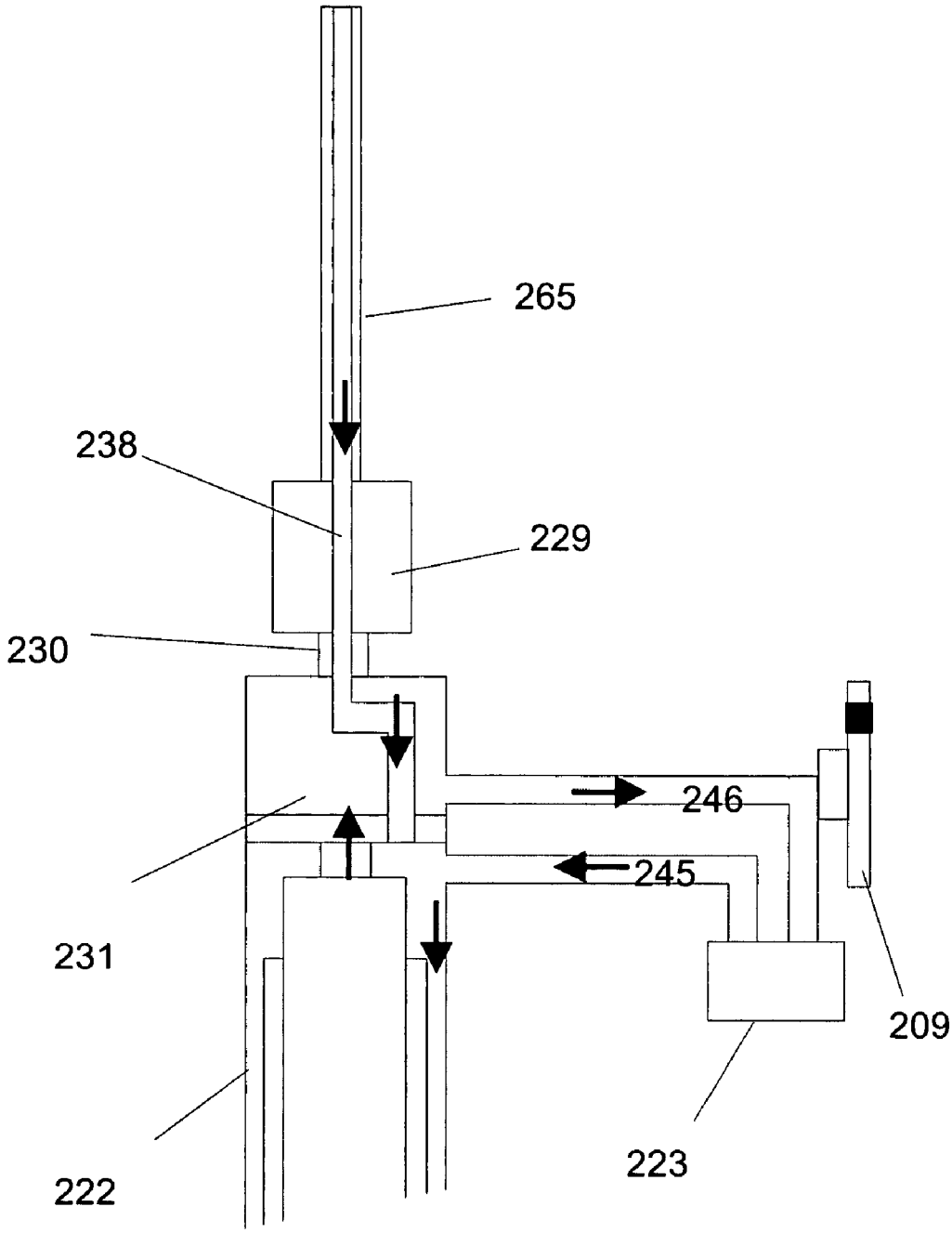
FIG. 11 attached shows an alternative installation tool where the washing (hydrocarbon displacement) of the pumping module is made possible before its retrieval through the flow inside the drill pipe riser.

FIG. 11 shows an alternative of an installation tool 229 where the washing (hydrocarbon displacement) of the pumping module 222 is made possible before its withdrawal through the flow inside the drill pipe riser 265. In this case the installation tool 229 of pumping module 222 will have a communication orifice 238 for fluid passage, for communication with the pumping module 222. In this way the injection near the flow inlet 245 so as to displace oil and gas contained within the said pumping module is made possible before the retrieval of same. All the pumped fluid will flow from the flow outlet 246 towards the production line and Production Stationary Unit (PSU).

Although not shown in the Figure, it is possible to perform said washing by injecting washing fluid from the PSU using a line of the umbilical.

Figure 12A:
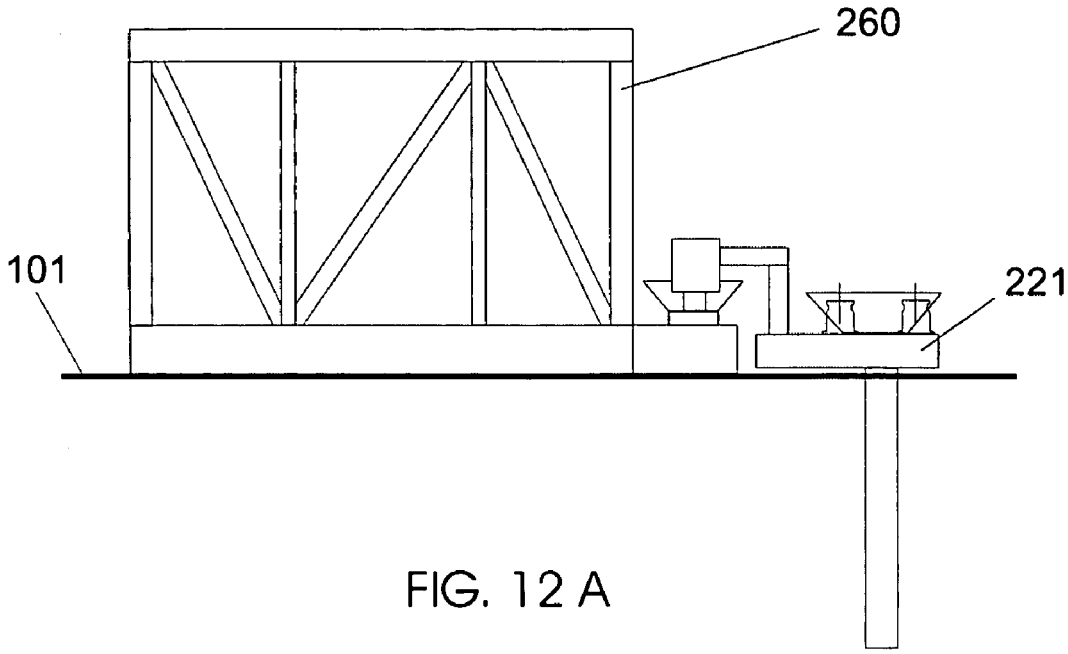
FIG. 12A attached shows the direct vertical connection of one or more PuAB's with a manifold.

FIG. 12A shows the interconnection of a PuAB 221 with a manifold 260. Such Figure shows that the concept and the modes illustrated in previous Figures, that is, a system for the direct vertical connection between two or more any pieces of subsea equipment can be applied to the several state-of-the-art subsea equipment, for already installed equipment as well as for new, not yet installed equipment.

Figure 12B:
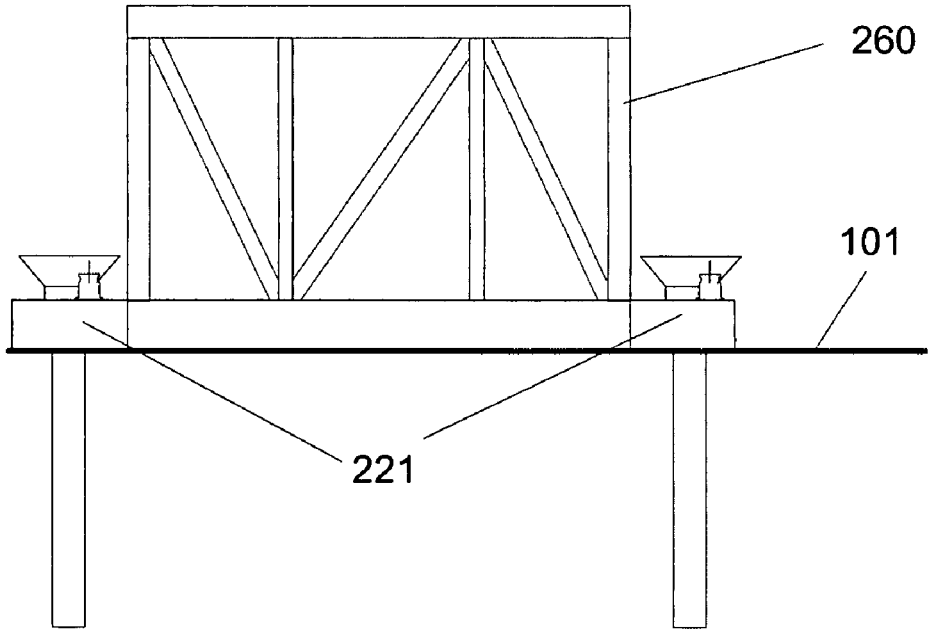
FIG. 12B attached shows the integration, in a same structure, of one or more PuAB's with a manifold.

FIG. 12B shows the interconnection of PuAB 221 with the structure of the manifold 260 itself. In this case there is no need to build a PuAB 221. This alternative increases the size of the manifold 260 base, while dispensing with the need of direct connection between production mandrel 107 and PuAB 221.

Although not shown in the Figures, through the addition of a mandrel to PuAB 221, it is also possible to interconnect through a jumper a second well in the pump suction, so that both wells will work in a piggy back mode (interconnected and producing through a same flow line and riser) with conventional equipment (PuAB, WCT or HWCT).

Method for Installing the System

The method for installing the present system encompasses two modes, illustrated by FIGS. 13 and 14 described below.

The method for installing the other modes, schematically shown in FIGS. 6, 7 and 8 will not be described in detail in view of the similarity with the described mode and easily understood by an expert.

According to one of such modes, FIGS. 13A, 13B, 13C and 13D show schematically the installation method steps of the inventive system with the sequence of the PUAB 221 installation, which is directly connected to the PrAB 104 production mandrel 107, or to a HWCT, or to a manifold, as seen in FIG. 4.

Figure 13A:
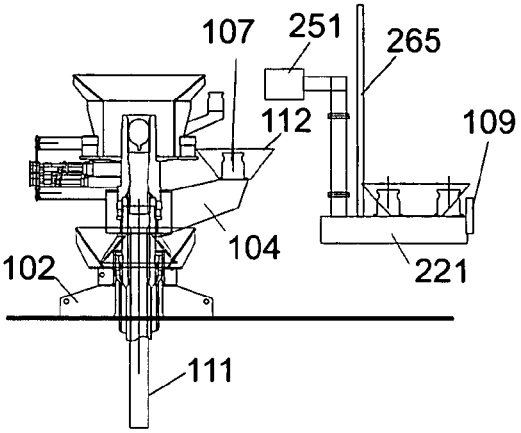
FIGS. 13A, 13B, 13C and 13D attached illustrate one mode of the method for installation of the present system, said mode relating to the sequence of installation of the PuAB that is directly connected to the production mandrel of the PrAB or HWCT.

FIG. 13A shows a PuAB 104 already positioned on the wellhead 103, and the PuAB 221 descent, which can be made by a cable (not represented) or by a drill pipe 265. Connector 251 is placed close to production mandrel 107. PuAB 221 is positioned with the aid of funnel guide 112. Then, through panel 109, a ROV performs the locking of connector 251. A pressure test is performed to assess if the sealing of the connection between mandrel 107 and connector 251 is adequate.

Figure 13B:
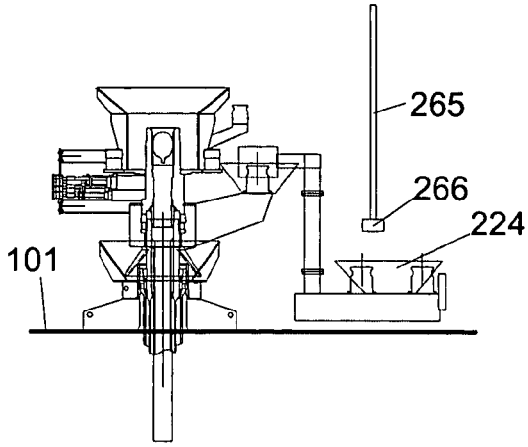

FIG. 13B shows in sequence, the PuAB 221 positioned and the descent of a drilling string made up of a bit 266 installed at the end of a drill pipe 265, said bit and said drill pipe being guided by a funnel guide 224 for drilling a borehole 239 (not represented) in the marine soil 101. After the drilling of the borehole 239 the bit 266 and the drill pipe 265 are retrieved.

Figure 13C:
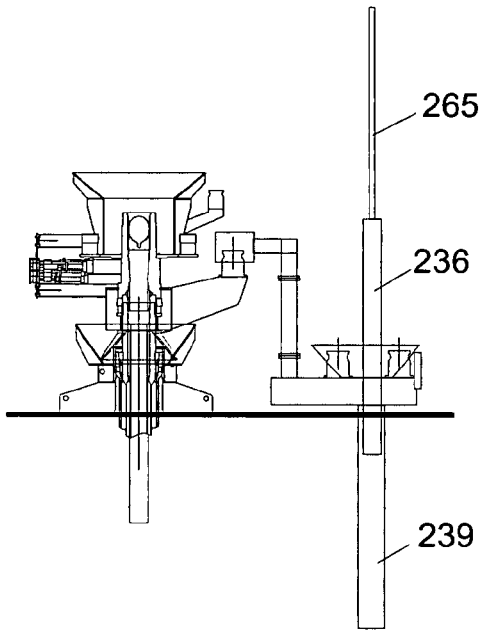

FIG. 13C shows in sequence, the descent of a casing 236 to be cemented in borehole 239 so as to impart strength and keep the casing 236 embedded in the marine soil 101.

Figure 13D:
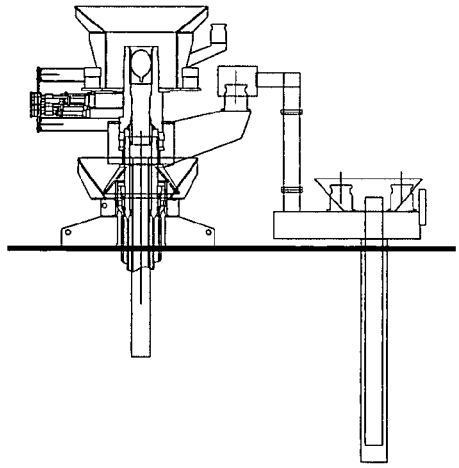

FIG. 13D shows in sequence, after the ascent of the drilling string that PuAB 221 will be locked to casing 236 through ROV panel 109.

According to a second mode of the installation mode, FIGS. 14A, 14B, 14C and 14D show schematically the installation sequence of pumping module PUMO 222 which is directly connected to a PrAB 104 (or a HWCT, or a manifold), modified through a flow mandrel 237 as described in FIG. 5.

Figure 14A:
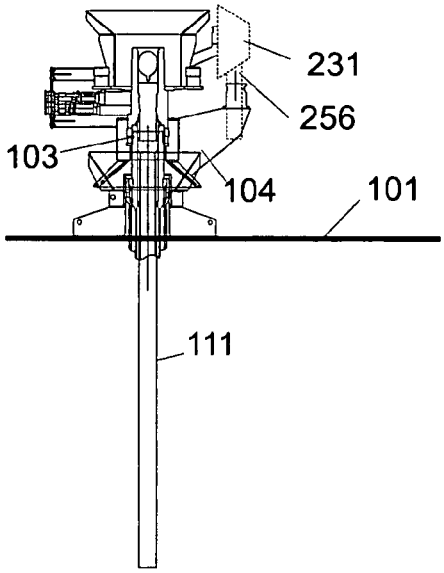
FIGS. 14A, 14B, 14C and 14D attached illustrate another mode of the method for installation of the pumping module PUMO that is directly connected to a PuAB or a HWCT modified with the aid of a flow mandrel.

FIG. 14A shows a modified PrAB 104 already positioned in the wellhead 103, fitted with a flow mandrel 237 and a structure 256 having a funnel guide 231.

Figure 14B:
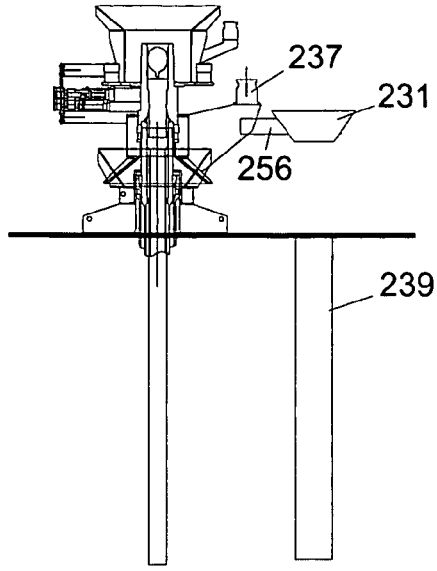

FIG. 14B shows in sequence, a borehole 239 in marine soil 101, drilled and guided through a funnel guide 231.

Figure 14C:
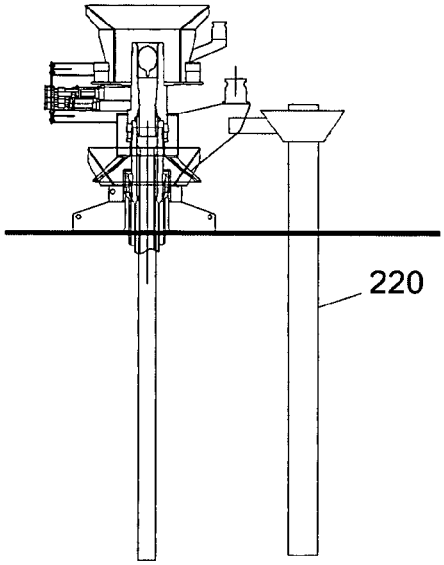

FIG. 14C shows in sequence, cased borehole 220 made up of a casing 236 (not represented), cemented in borehole 239.

Figure 14D:
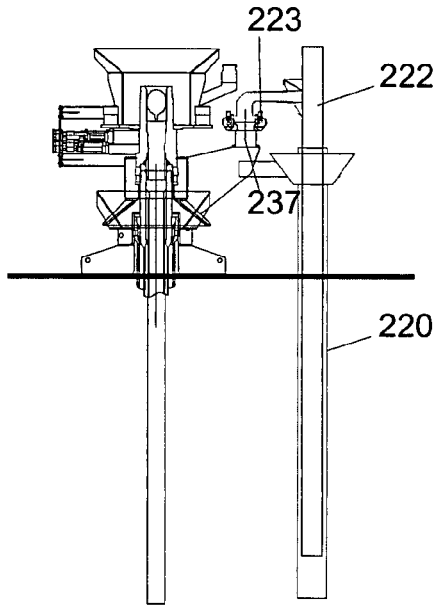

FIG. 14D shows in sequence, the pumping module 222 housed in the interior of the cased borehole 220 and locked to flow mandrel 237 by connector 223. A pressure test is performed in order to assess the adequate connection between connector 223 and flow mandrel 237.

Although the present invention has been described with relation to certain of its preferred modes, it should be clear for the experts that several alterations, combinations and modifications can be effected therein without departing from the spirit and scope of same, which is limited only by the appended claims.

We claim:

1. A system for direct vertical connection between a first contiguous subsea equipment and a second contiguous subsea equipment, wherein the first equipment and the second equipment are utilized in the production of hydrocarbon fluids, with hydrocarbon flow and/or control interconnection between the first equipment and the second equipment, and the first equipment is already installed in a marine soil, the system comprising:

a production mandrel integral to the first subsea equipment, the production mandrel including a funnel guide for interconnection with the second equipment; and a connector fitted to the second equipment, wherein the connector is fitted and locked with the mandrel;

wherein the funnel guide serves as an approaching guide between said first equipment and said second equipment, and mechanical and flow interconnections are completed between said first equipment and said second equipment only by a fitting between the connector and the mandrel, whereby connecting jumpers are not provided; and wherein the first equipment is a production adapter base (PrAB), a horizontal wet Christmas tree (HWCT), a manifold or a pipe line end termination (PLET), and the second equipment is a pumping adapter base (PuAB).

2. A system according to claim 1, wherein the PuAB includes a remotely operated vehicle (ROV) interface panel, that is designed for locking and unlocking the connector and effecting a connector sealing test.

3. A system according to claim 2, wherein a measurement module, a separation module, a pumping module, a heating module, and a vertical connection module (VCM) are coupled to the PuAB.

4. A system according to claim 1, wherein the PuAB is directly supported by the marine soil.

5. A system according to claim 4, wherein the PuAB is an adjustable PuAB with a sub base, a pantographic structure, and one or more hydraulic jacks actuated with the aid of the ROV panel, whereby the PuAB can be provided on uneven marine soil.

6. A system according to claim 4, wherein a pipe span is provided between the connector and the PuAB, the pipe span including a rigid span and a spool, wherein a modification in a height of the spool compensates for the rigid span.

7. A system according to claim 3, wherein the pumping module is placed externally, enabling the installation of a pump.

8. A system for direct vertical connection between a first contiguous subsea equipment and a second contiguous subsea equipment, wherein the first equipment and the second equipment are utilized in the production of hydrocarbon fluids, with hydrocarbon flow and/or control interconnection between the first equipment and the second equipment, and the first equipment is already installed in a marine soil, the system comprising:

a flow mandrel and a template funnel, wherein the flow mandrel and the template funnel are both integral to the first equipment, and the template funnel is connected to the first equipment by a structure with a hinge, wherein a cased borehole, which is constructed by drilling or blasting in the marine soil, is provided within the template funnel, the cased borehole houses a pumping module with a connector that is directly connected to the flow mandrel, and mechanical and flow interconnections are completed between said first equipment and said second equipment only by a fitting between the connector and the mandrel, whereby connecting jumpers are not provided;

wherein the first equipment is a production adapter base (PrAB), a horizontal wet Christmas tree (HWCT), a manifold or a pipe line end termination (PLET) and the second equipment is the pumping module.

9. A system for direct vertical connection between a first contiguous subsea equipment and a second contiguous subsea equipment, wherein the first equipment and the second equipment are utilized in the production of hydrocarbon fluids, with hydrocarbon flow and/or control interconnection between the first equipment and the second equipment, and the first equipment is already installed, said system comprising:

a drilling base fitted with two template funnels, both of the template funnels integral to the said base, wherein the first funnel guides the drilling of a well in a marine soil, and the second funnel guides the construction of a cased borehole by drilling or blasting in the marine soil, the case borehole housing a pumping module in the vertical position and completing mechanical and flow interconnections to a mandrel fitted in the base, whereby the base serves as a true template for the well or the cased borehole, this enabling knowledge and accuracy of measures such as separation and distance between said well and said borehole.

10. A system according to claims 9, wherein said system comprises two cased boreholes in the marine soil, each cased borehole containing a pumping module.

11. A system according to claims 8 or 9, wherein two pumping modules are installed in one single cased borehole.

12. A system for direct vertical connection between a first contiguous subsea equipment and a second contiguous subsea equipment, wherein the first equipment and the second equipment are utilized in the production of hydrocarbon fluids, with hydrocarbon flow and/or control interconnection between the first equipment and the second equipment, and the first equipment is already installed, the system comprising:

a) pumping adapter base (PuAB) with two pumping modules housed in two cased boreholes;

b) a first tubular flow line connecting the PuAB with a mandrel of a production adapter base (PrAB), said line being fitted with:

i) a valve with a hydraulic actuator for passing a pig;

ii) two derivations, a first derivation interconnected to the suction of the first pumping module and a second derivation interconnected to the discharge of the second pumping module;

c) a second tubular flow line for interconnecting the discharge of the first pumping module with the suction of the second pumping module; and d) four blocking valves operated by a remotely controlled vehicle (ROV); a valve in the suction of the first pumping module, a valve in the discharge of the first pumping module, a valve in the suction of the second pumping module, and a valve in the discharge of the second pumping module.

13. A system according to claims 8 or 9, wherein said system comprises an installation tool fitted with a communication orifice with the pumping module so as to enable the injection near the fluid inlet, allowing the hydrocarbon displacement out of the pumping module before the retrieval of same through flow by the interior of the drill pipe riser.

14. A system according to claim 13, wherein the fluid flows from the flow outlet towards the production line and a stationary production unit (SPU).

15. A method for installation of a system for direct vertical connection between a first contiguous subsea equipment and a second contiguous subsea equipment, wherein the first equipment and the second equipment are utilized in the production of hydrocarbon fluids, with hydrocarbon flow and/or control interconnection between the first equipment and the second equipment, said method comprising:

a) providing the first equipment fitted with a funnel guide and a mandrel, the first equipment being a production adapter base (PrAB) that is already installed on a wellhead;

b) descending a pumping adapter base (PuAB) fitted with a connector and a funnel guide, by cable or drill pipe and positioning the connector close to the mandrel, the PuAB being the second equipment and being positioned with aid of the funnel guide, wherein the connector is locked to the mandrel by a remotely operated vehicle (ROV)-actuating panel, whereby connecting jumpers are not provided;

c) performing a sealing test of the connection between mandrel and connector;

d) descending a drill pipe with a bit guided through the funnel guide of the PuAb, wherein the drill pipe drills a borehole in the marine soil, and retrieving said drill pipe after construction of the borehole, with the PuAB positioned;

e) descending a casing and cementing the casing in the borehole so as to impart strength and keep the casing embedded in the marine soil; and f) locking the PuAB to the casing with aid of the ROV panel.

16. A method for installation of a system for direct vertical connection between a first contiguous subsea equipment and a second contiguous subsea equipment, wherein the first equipment and the second equipment are utilized in the production of hydrocarbon fluids, with hydrocarbon flow and/or control interconnection between the first equipment and the second equipment, said method comprising:

a) providing the first equipment, which is already positioned in a wellhead, the first equipment being fitted with a flow mandrel and a structure with a funnel guide and a hinge;

b) with the aid of the funnel guide, guiding and drilling a borehole in the marine soil;

c) cementing in the borehole a casing; d) housing a pumping module with a connector in the cased borehole and locking connector to the flow mandrel, whereby connecting jumpers are not provided; and e) performing a sealing test of the connection between connector and the flow mandrel.

* * * * *